US010596438B1

(12) United States Patent
Gambrell

(10) Patent No.: US 10,596,438 B1
(45) Date of Patent: Mar. 24, 2020

(54) SWIMMER RESTRAINT DEVICE

(71) Applicant: Phillip Gambrell, Prospect, KY (US)

(72) Inventor: Phillip Gambrell, Prospect, KY (US)

( * ) Notice: Subject to any disclaimer, the term of this patent is extended or adjusted under 35 U.S.C. 154(b) by 213 days.

(21) Appl. No.: 15/614,321

(22) Filed: Jun. 5, 2017

Related U.S. Application Data

(60) Provisional application No. 62/346,259, filed on Jun. 6, 2016.

(51) Int. Cl.
*A63B 69/12* (2006.01)

(52) U.S. Cl.
CPC ..... *A63B 69/12* (2013.01); *A63B 2208/03* (2013.01); *A63B 2244/20* (2013.01)

(58) Field of Classification Search
CPC ..... A63B 69/00; A63B 69/01; A63B 67/01; A63B 67/02; A63B 21/02; A63B 21/04; A63B 21/05
See application file for complete search history.

(56) References Cited

U.S. PATENT DOCUMENTS 2,825,224 A 3/1958 Lindenauer et al.
3,512,416 A * 5/1970 Hohwart ..... A63B 69/12 482/55
3,861,675 A * 1/1975 Hopper ..... A63B 69/12 482/55
3,988,020 A * 10/1976 Carter ..... A63B 69/12 482/55
4,095,657 A * 6/1978 Hohwart ..... A63B 69/12 434/254
4,109,905 A * 8/1978 Meier ..... A63B 69/12 24/115 H
4,247,096 A * 1/1981 Schmitt ..... A63B 69/12 273/DIG. 30
4,248,419 A * 2/1981 Hohwart ..... A63B 69/12 482/105
4,524,711 A * 6/1985 Ashrow ..... A63B 69/12 114/215
4,962,923 A * 10/1990 Earner ..... A63B 69/12 482/55
5,020,791 A 6/1991 Phillips
5,236,404 A 8/1993 MacLennan
5,391,080 A * 2/1995 Bernacki ..... A63B 69/12 434/254
5,813,945 A * 9/1998 Bernacki ..... A63B 21/153 434/247
5,816,982 A * 10/1998 Croushore ..... A63B 69/12 482/55
5,823,564 A * 10/1998 Kettler ..... B62B 7/10 280/642
7,104,932 B1 * 9/2006 Brentlinger ..... A63B 69/12 434/254
7,175,569 B1 * 2/2007 Lan ..... A63B 69/12 434/254
8,226,110 B2 * 7/2012 Liao ..... B62B 7/062 280/47.38

(Continued)

*Primary Examiner* — Garrett K Atkinson
(74) *Attorney, Agent, or Firm* — Law Office of JL Simunic; Joan L. Simunic

(57) ABSTRACT

The present development is a device that restrains an individual from swimming beyond a predetermined range. The device comprises a frame, at least one ballast unit, at least one tether line and a means to secure the swimmer to the tether line. The device is intended to be portable and easy to use while still providing a sturdy restraint.

17 Claims, 4 Drawing Sheets

(56) References Cited

U.S. PATENT DOCUMENTS

| | | | | |
|---|---|---|---|---|
| 8,388,502 | B2 | 3/2013 | Tedhams | |
| 9,265,984 | B2 | 2/2016 | Huber | |
| 9,265,990 | B2 * | 2/2016 | Reese | A63B 31/00 |
| 9,517,791 | B1 * | 12/2016 | Hawk | B62B 9/26 |
| 9,604,088 | B2 * | 3/2017 | Djang | A63B 69/12 |
| 9,950,732 | B1 * | 4/2018 | Patterson | B62B 19/02 |
| 2006/0166175 | A1 * | 7/2006 | Lan | A63B 69/12 434/254 |
| 2012/0264574 | A1 * | 10/2012 | Chang | A63B 69/12 482/55 |
| 2014/0230747 | A1 * | 8/2014 | Jakubowski | B62B 9/14 119/496 |
| 2017/0066466 | A1 * | 3/2017 | Hawk | B62B 9/26 |
| 2018/0132446 | A1 * | 5/2018 | Jakubowski | A01K 1/0236 |
| 2018/0178824 | A1 * | 6/2018 | Hanson | B62B 5/068 |

* cited by examiner

SWIMMER RESTRAINT DEVICE

CROSS-REFERENCE TO PRIOR APPLICATIONS

The present application claims priority to U.S. Patent Application 62/346,259 filed 2016 Jun. 6, which is incorporated by reference in its entirety.

FIELD OF THE INVENTION

The invention relates to a device to restrain a swimmer in a pool thereby allowing the swimmer to swim for a longer period of time without interrupting his or her rhythm with flips or turns as would be required upon reaching the end of the pool.

BACKGROUND OF THE INVENTION

If an individual desires to swim for a long period of time in a pool, he or she must reverse direction at each end of the pool. This can interrupt the swimmer's swimming stroke pattern and waste valuable time. Further, if the swimmer is training for a long-distance swimming event, the actions required to reverse direction do not emulate his or her training need.

To overcome the problem of having to reverse directions, it would be beneficial to have a means for restraining a swimmer's forward motion, thereby essentially prohibiting the swimmer from reaching an opposing end of the pool. The prior art teaches several approaches to accomplish this restraint. For example, the swimmer may be tethered to a device permanently affixed to a pool deck or the side of a pool, such as taught in U.S. Pat. No. 4,529,192 or in U.S. Pat. No. 4,530,497. In a different approach, the swimmer may be tethered to a cable attached to a structure permanently attached to the pool, such as a pool ladder, as taught in U.S. Pat. No. 5,236,404 or in U.S. Pat. No. 7,104,932. Alternatively, the swimmer may be tethered to a heavily-weighted device positioned on the side of the pool, such as taught in U.S. Pat. No. 3,861,675 or in U.S. Pat. No. 8,388,502. However, each of these approaches either requires a permanent fixture on the pool or requires a device that is cumbersome to move. Thus, both situations restrict the swimmer to using a single pool or training location.

Because a swimmer may not have access to a single pool, or may travel and wish to train while away from his or her normal training pool, it would be beneficial to have a relatively light-weight and portable device that can be easily transported but that can be adapted to create a device that will restrain a swimmer in a limited space. The present development provides a portable device that a swimmer may easily set up and remove from any pool.

SUMMARY OF THE PRESENT INVENTION

The present development is a device that an individual can use to restrain a swimmer from making forward progress during swimming exercises. The device comprises a frame, at least one ballast unit, at least one tether line and a means to secure a swimmer to the tether line. The device is intended to be positioned on the side of a pool of water or on a pool deck. Specifically, the frame is positioned on a stable surface near a pool of water, the ballast is positioned on the frame to provide a weight to hold the frame in a predetermined position, the tether line is secured to the frame, and the swimmer is secured to the tether line.

In a preferred embodiment, the ballast unit is designed to allow the swimmer to fill the ballast unit with water to provide the necessary weight during use and to further allow the swimmer to then empty the ballast unit after an exercise or workout session. In an alternative embodiment, the swimming restraint device is designed and proportioned to be easily portable. In a second alternative embodiment, the swimming restraint device is proportioned to easily fit in an airline authorized carry-on bag.

DETAILED DESCRIPTION OF THE PRESENT DEVELOPMENT

The following description is intended to provide the reader with a better understanding of the invention. The description is not intended to be limiting with respect to any element not otherwise limited within the claims. For example, the present invention will be described in the context of use with a commonly known swimming pool, but the teachings herein are not limited to use in swimming pools.

Figure 1:
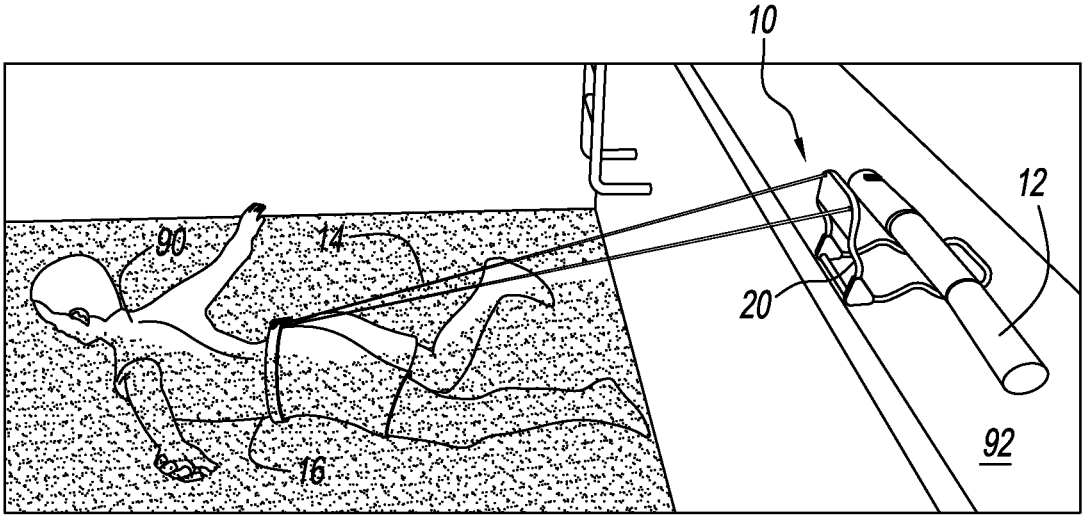
FIG. 1 is a perspective view of a first embodiment of the device of the present development in the open position and situated on a pool deck with the ballast container positioned to restrain the frame of the device and with a swimmer secured within a belt tethered to the frame.

As shown in FIGS. 1-10, the present development is a swimmer restraint device 10 that an individual can use to restrict forward progress during swimming exercises. As shown in FIG. 1, the device 10 comprises a frame 20, at least one ballast unit 12, at least one tether line 14 and a means 16 to secure a swimmer to the tether line. The swimmer restraint device 10 is intended to be positioned on the side of a pool of water or on a pool deck or on any stable surface near a body of water.

To use the device 10, a swimmer 90 positions the frame 20, to which the tether line 14 is secured, on a stable surface 92 with the ballast unit 12 positioned to securely hold the frame 20 on the surface even when the frame 20 is subjected to a force pulling against the frame 20, such as when the swimmer is trying to swim away from the device 10. With the frame 20 and ballast unit 12 positioned, the swimmer 90 is secured to the tether line 14 by the means 16, such as a belt or vest or girdle, affixed to the tether line 14. As the swimmer 90 attempts to move in the water in a direction directly opposed to the position where the frame 20 is positioned, the frame 20 and ballast unit 12 hold firm on the surface 92 so the swimmer 90 is restrained and has limited forward progress.

Figure 2:
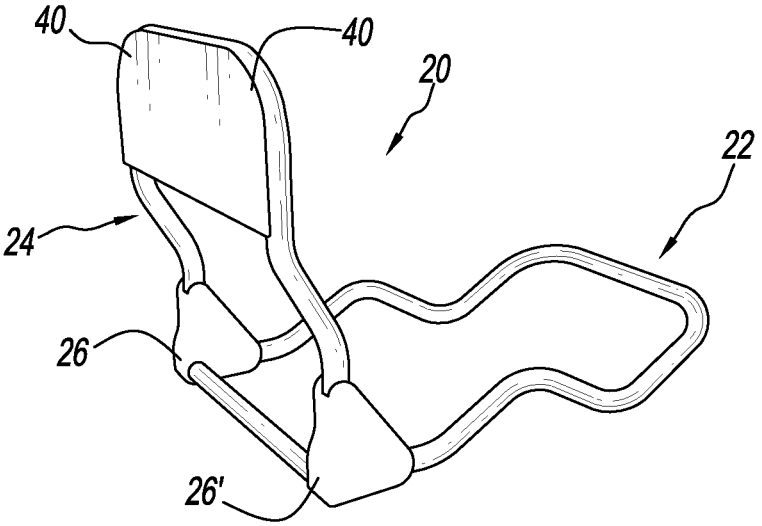
FIG. 2 is a perspective view of the frame of the device of FIG. 1 in the open position.
Figure 3:
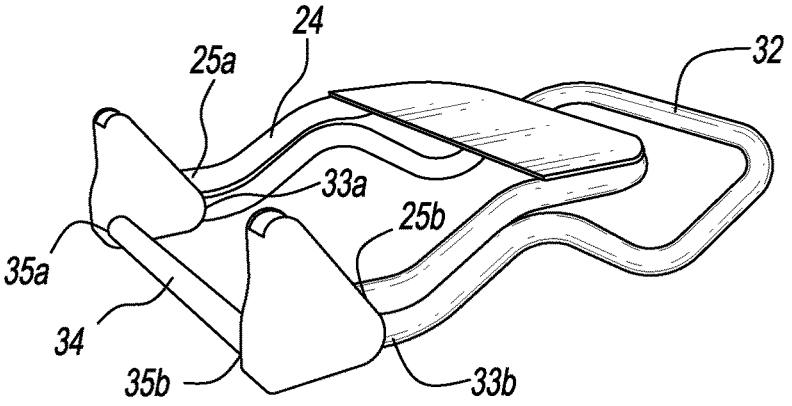
FIG. 3 is a perspective view of the frame of the device of FIG. 1 in the closed position.
Figure 6:
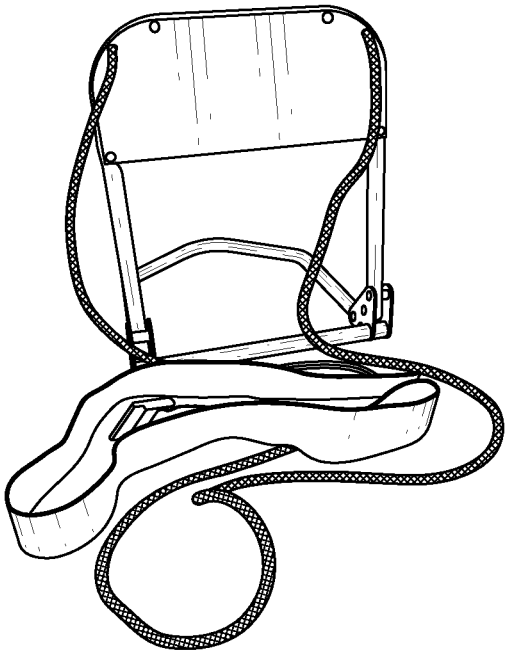
FIG. 6 is a perspective view of the frame of a second alternative embodiment of the device of FIG. 1 in the open position.
Figure 7:
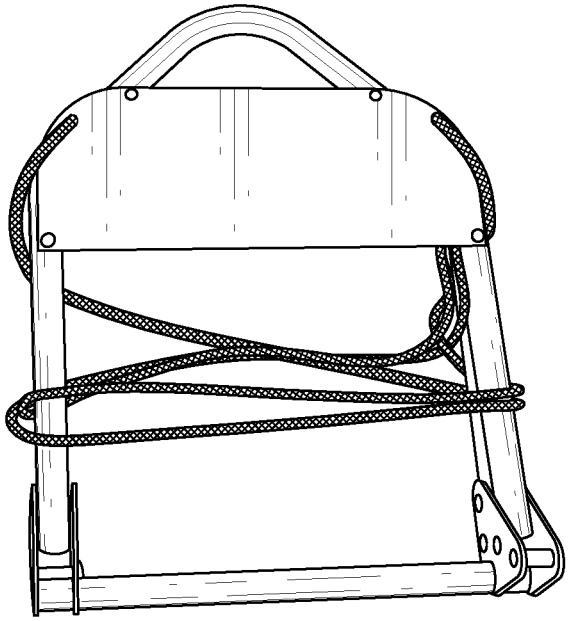
FIG. 7 is a perspective view of the frame of the device of FIG. 6 in the closed position.

As shown in FIGS. 2 and 3, the frame 20 comprises a base segment 22, a face segment 24, and a pair of folding joints 26, 26'. The base segment 22 comprises a U-shaped segment 32 and a bar 34. The U-shaped segment 32 defines a first end 33A and a second end 33B. As used herein, "U-shaped" may be interpreted to be configuration that generally has a U-shape with a first end and a second end, such as, but not limited to a rounded-U configuration, a three-sided-U configuration as shown in FIGS. 2 and 3, or a four-sided-U configuration as shown in FIG. 6. The first end 33A is attached to a first brace 26; the second end is attached to a second brace 26'. The bar 34 defines a first end 35A and a second end 35B, and is positioned such that the first end 35A is attached to the first brace 26 and the second end 35B is attached to the second brace 26'. When the U-shaped segment 32, folding joints 26, 26', and bar 34 are connected, they form a closed loop. In a preferred embodiment, the U-shaped base frame segment 32 may be bent in a sinusoidal wave pattern along the sides of the frame segment 32 that include the ends 33A, 33B, with the wavelength large enough to allow the ballast unit 12 to lay within a trough of a wave and not roll away from the frame 20. A first alternative embodiment 110 is shown in FIG. 6. In the alternative embodiment 110, the U-shaped base frame segment 132 may be essentially flat to allow one plane of the frame segment 132 to abut the surface 92 when the device is in the open position.

As shown in FIGS. 2-7, the face segment 24 is a U-shaped segment equal in length or shorter than the base segment 22. The face segment 24 defines a first end 25A and a second end 25B. The first end 25A attaches to the first brace 26 and the second end 25B attaches to the second brace 26', such that in an open position the face segment 24 and the base segment 22 form a three-dimensional L-shaped structure with the base segment 22 creating the base of the "L". Optionally, the face segment 24 may be bent to complement the bent shape of the base frame segment 32 to allow for more compact folding of the unit 20.

Figure 4:
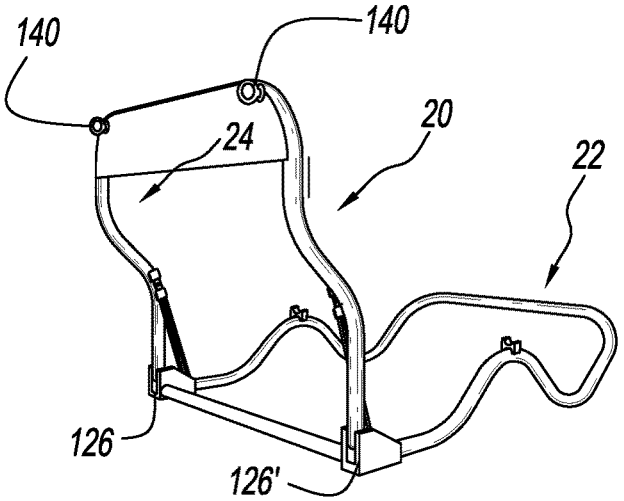
FIG. 4 is a perspective view of the frame of a first alternative embodiment of the device of FIG. 1 in the open position.
Figure 5:
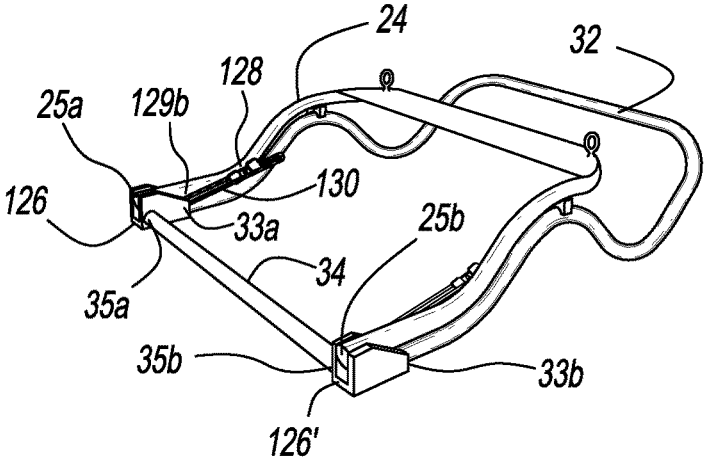
FIG. 5 is a perspective view of the frame of the device of FIG. 4 in the closed position.

The folding joints 26, 26' may be any means that allows the base segment 22 to be held in a first position such that the face segment 24 lies parallel to the base segment 22 in a closed position and that also allows the face segment 24 to move to an open position that places the base segment approximately 90° from the face segment's 24 closed position. Exemplary folding joints 26, 26' include brackets that allow for axles to secure the frame ends to the brackets, or folding mechanisms such as taught in U.S. Pat. No. 5,823,564 and in U.S. Pat. No. 8,226,110, or friction hinges with protective sleeves, among others. A first embodiment, a unitary triangular bracket, is shown in FIGS. 1-3 and 6-8. A first alternative embodiment is shown in FIGS. 4-5 and includes a protective sleeve 126, 126' with a lock 128 and slide 130, as are known in the art.

Figure 8:
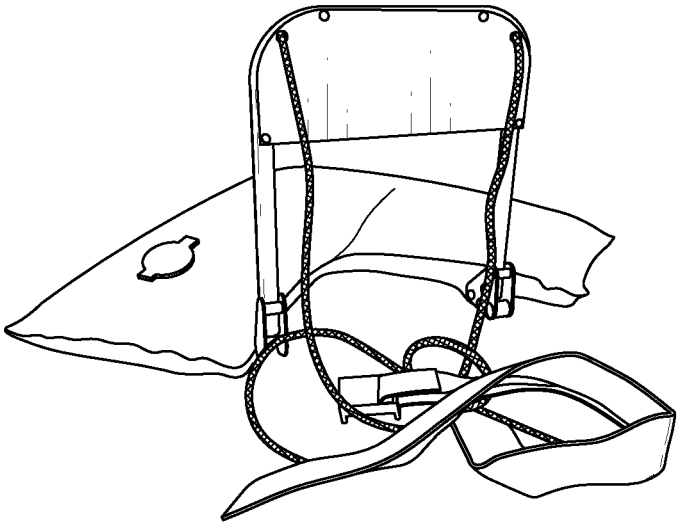
FIG. 8 is a perspective view of the frame of the device of FIG. 6 in the open position and with a first alternative ballast placed on the frame in a use position.
Figure 9:
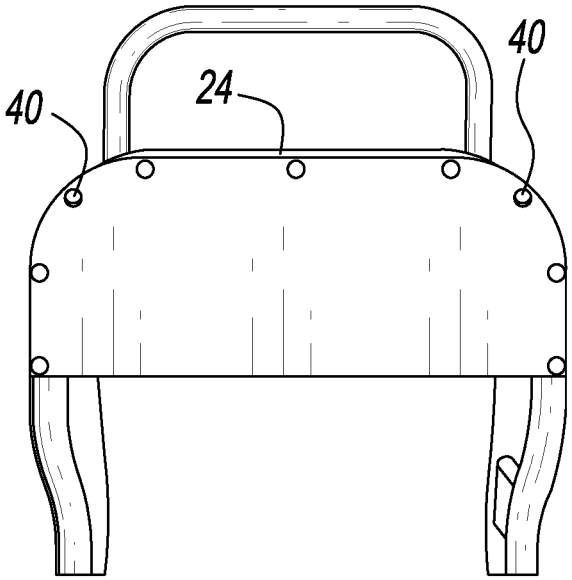
FIG. 9 is a front view of the face segment of the device of FIG. 1 showing the apertures.

As shown in FIG. 9, at least one aperture 40 is provided on the face segment 24. Preferably, the aperture 40 is positioned closer to the mid-point of the U-shaped segment than to the ends 25A, 25B. In a preferred embodiment, a plurality of apertures are provided in the face segment 24. In a more preferred embodiment, a pair of apertures are provided in the face segment 24 with the apertures positioned approximately equidistant from the mid-point of the U-shaped segment. The aperture 40 may be create by, for example, punching a hole through the face segment frame 24, as shown in FIGS. 1-3 and 6-9, or by securing eyebolts 140 to the face segment frame 24, as shown in FIGS. 4-5.

Figure 10:
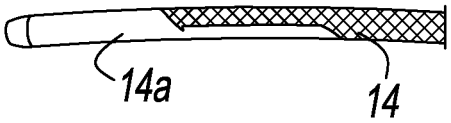
FIG. 10 is a side view of the end of the tether line for the device of FIG. 1; and, FIG. 11 is a perspective view of the back of the face segment of the device of FIG. 1 with the tether line inserted through the aperture.
Figure 11:
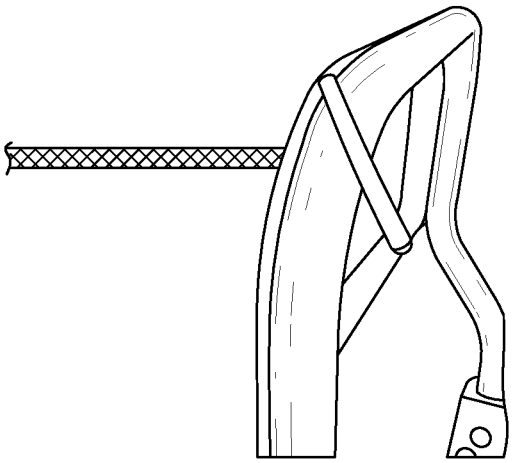

Referring again to FIG. 1, the tether line 14 is secured to the frame 20 and to the swimmer securing means 16. The tether line 14 may be made from any material that will retain tension when exposed to water, such as cotton cord, polypropylene cord, nylon cord, combinations thereof, or other materials known in the art. The tether line 14 may be made from a taunt material or the material may have some inherent stretching properties, such as a bungee cord or climbing rope or kernmantle-design rope. In FIG. 1 and in the exemplary embodiments presented later herein, the tether line 14 comprises two separate lines or cables, each attached to the frame 20 and to the swimmer securing means 16. However, it is anticipated that: (a) the tether line 14 could be a single line or cable with two ends, wherein a first end is attached to the frame 20, approximately the center-point of the line 14 attaches to the swimmer securing means 16, and the second end of the line 14 is attached to the frame 20; or, (b) the tether line 14 could be a single loop of line or cable that attaches to the frame 20 and is attached to the swimmer securing means 16; or, (c) any other configuration of tether line 14 or cable that will force the swimmer securing means 16 to remain within a predetermined distance of the frame 20 even if the swimmer 90 is exerting a force to move away from the frame 20. A first embodiment of a tether line 14 is shown in FIGS. 10 and 11, wherein the tether 14 line has a metal cup 14A attached to the end of the tether line 14, and the metal cup 14A is fed through the aperture 40 on the frame 20 and secured against the frame 20 in a manner to restrict the tether line end from becoming unattached from the frame. Alternatively, cord end caps that include a means, such as lobster claw clasps, to secure the tether line 14 to the frame 20 may be used. A variety of these types of end caps are known in the art.

The swimmer securing means 16 is intended to secure the swimmer to the tether line 14. The securing means 16 should allow the swimmer free movement of the arms and legs. Recommended securing means 16 include a belt, as shown in FIG. 1, or a vest or girdle (not shown). In a preferred embodiment, the means is a belt, which tends to provide the most freedom of movement to the swimmer while restricting the forward progress due to the belt's attachment to the tether line 14. The swimmer securing means 16 may be reversibly secured to the tether line 14, such as by a loop attached to the securing means 16 that the tether line 14 passes through, or the tether line 14 may be fixedly attached to the securing means 16, such as by being sown onto the securing means 16.

The ballast unit 12 provides a counterweight to the swimmer 90. Anything that is capable of holding the frame 20 on the pool deck 92 while the swimmer 90 is exerting a force on the swimmer restraint device 10 may be used as the ballast unit 12. Ideally, the ballast unit 12 will provide a counterweight of at least 24 pounds, and preferably a counterweight of at least 30 pounds and more preferably a counterweight of about 35 pounds. In an exemplary embodiment, the ballast unit 12 has the capacity to hold from about 3.0 gallons of water to about 6.0 gallons of water. In a more preferred embodiment, the ballast unit 12 holds from about 3.8 gallons of water to about 5.0 gallons of water. In a most preferred embodiment, the ballast unit 12 holds about 4.1 gallons of water. In a preferred embodiment, as shown in FIG. 1, the ballast unit 12 is a flexible, elongated tube that can be filled with water and sealed to retain the water within the tube, and then can be opened to allow the water to drain from the tube. In a more preferred embodiment, as shown in FIG. 8, the ballast unit 112 is a pillow or bladder that can be filled with water and sealed to retain the water within the tube, and then can be opened to allow the water to drain from the tube. In a most preferred embodiment, the ballast unit 12, 112, has a V-shaped configuration sized to cover not less than about 50% of the U-shaped segment 32, 132. Although the embodiments shown in the figures and described herein refer to a one-piece ballast unit, it is anticipated that the ballast unit may comprise multiple pieces or segments. For example, the ballast unit may be a multi-segmented bladder that will allow the user to fill each segment separately or the ballast unit may be comprised of multiple bladders that can each be filled separately and then used in combination to create the ballast unit.

In a first exemplary embodiment, the swimmer restraint device 10 has the following components: (1) a base U-shaped segment 32 comprised of 6061-T6 aluminum tubing having an outside diameter of about 0.75 inch wherein the tubing is bent to create a three-sided-U-shaped structure having two approximately 18-inch base side arms contiguous to the first end 33A and second end 33B, respectively, and an approximately 12-inch segment connecting the two base side arms; (2) a bar 34 comprised of 6061-T6 aluminum tubing having an outside diameter of about 0.75 inch wherein the tubing is approximately 12 inch in length; (3) a face segment 24 comprised of 6061-T6 aluminum tubing having an outside diameter of about 0.75 inch wherein the tubing is bent to create a three-sided-U-shaped structure having two approximately 14-inch face side arms contiguous to the first end 25A and second end 25B, respectively, and an approximately 12-inch segment connecting the two face side arms; (d) two brackets 26, 26', each having a length of about 3.0 inches and a width of about 1.0 inches, wherein each bracket is configured to attach to the base U-shaped segment 32, the bar 34, and the face segment 24, and wherein the brackets are composed of a sturdy material, such as heavy-duty polymeric material; (e) a tether line 14 comprising two approximately 3/16-inch diameter nylon cords, each about 6-feet in length, with about 0.375-inch spring hooks attached on each end of each cord; (f) a swimmer securing means 16 comprising an approximately 48-inch adjustable poly-web belt; and (g) a ballast unit 12 comprising an approximately 6-inch diameter by 48-inch length vinyl water tube. The components (a)-(g) are assembled as previously described such that the finished swimmer restraint device 10 resembles the apparatus shown in FIG. 1.

In a second exemplary embodiment, the swimmer restraint device 10 has the following components: (1) a base U-shaped segment 32 comprised of 6061-T6 aluminum tubing having an outside diameter of about 0.75 inch wherein the tubing is bent to create a three-sided-U-shaped structure having two approximately 22-inch base side arms contiguous to the first end 33A and second end 33B, respectively, and an approximately 18-inch segment connecting the two base side arms; (2) a bar 34 comprised of 6061-T6 aluminum tubing having an outside diameter of about 0.75 inch wherein the tubing is approximately 18 inch in length; (3) a face segment 24 comprised of 6061-T6 aluminum tubing having an outside diameter of about 0.75 inch wherein the tubing is bent to create a three-sided-U-shaped structure having two approximately 18-inch face side arms contiguous to the first end 25A and second end 25B, respectively, and an approximately 14-inch segment connecting the two face side arms; (d) two brackets 26, 26', each having a length of about 5.875 inches and a width of about 2.125 inches, wherein each bracket is configured to attach to the base U-shaped segment 32, the bar 34, and the face segment 24, and wherein the brackets are composed of a sturdy material, such as a 22-guage sheet metal or a heavy-duty polymeric material; (e) two 6-inch friction hinges 28, 28'; (f) two approximately 0.25-inch diameter eyebolts 40 and means to secure the eyebolts to the face segment 24 (not shown); (g) a tether line 14 comprising two approximately 3/16-inch diameter nylon cords, each about 6-feet in length, with about 0.375-inch spring hooks attached on each end of each cord; (h) a swimmer securing means 16 comprising an approximately 48-inch adjustable poly-web belt; and (i) a ballast unit 12 comprising an approximately 6-inch diameter by 48-inch length vinyl water tube. The components (a)-(i) are assembled as previously described such that the finished swimmer restraint device 10 resembles the apparatus shown in FIG. 1.

In a third exemplary embodiment, the swimmer restraint device 110 has the following components: (1) a base U-shaped segment 32 comprised of 6061-T6 aluminum tubing having an outside diameter of about 0.75 inch wherein the tubing is bent to create a four-sided-U-shaped structure having two approximately 12-inch base side arms contiguous to the first end 33A and second end 33B, respectively, and an approximately 15-inch segment bent at about a 70° angle near the segment's midpoint connecting the two base side arms; (2) a bar 34 comprised of 6061-T6 aluminum tubing having an outside diameter of about 0.75 inch wherein the tubing is approximately 12 inch in length; (3) a face segment 24 comprised of 6061-T6 aluminum tubing having an outside diameter of about 0.75 inch wherein the tubing is bent to create a three-sided-U-shaped structure having two approximately 14-inch face side arms contiguous to the first end 25A and second end 25B, respectively, and an approximately 12-inch segment connecting the two face side arms; (d) two brackets 26, 26', each having a length of about 3.0 inches and a width of about 1.0 inches, wherein each bracket is configured to attach to the base U-shaped segment 32, the bar 34, and the face segment 24, and wherein the brackets are composed of a sturdy material, such as heavy-duty polymeric material; (e) a tether line 14 comprising two approximately 3/16-inch diameter nylon cords, each about 6-feet in length, with about 0.375-inch spring hooks attached on each end of each cord; (f) a swimmer securing means 16 comprising an approximately 48-inch adjustable poly-web belt; and (g) a ballast unit 12 comprising an approximately 6-inch diameter by 48-inch length vinyl water tube. The components (a)-(g) are assembled as previously described such that the finished swimmer restraint device 110 resembles the apparatus shown in FIG. 6.

The swimmer restraint device 10, 110 of the present development is designed to allow an individual to swim for an extended period of time in a pool or relatively confined space without having to stop and reverse direction at each end of the pool. Thus, the swimmer can swim without interrupting his or her swimming stroke pattern and wasting valuable time. If the swimmer is training for a long distance swimming event, the stopping to reverse direction does not emulate their training need, so the swimmer restraint device 10, 110 provides a better and more efficient training session.

Further, the design of the swimmer restraint device 10, 110 allows the device to be small enough to easily fit in an airline authorized carry-on bag.

Unless defined otherwise, all technical and scientific terms used herein have the same meaning as commonly understood by one of ordinary skill in the art to which the presently disclosed subject matter pertains. Representative methods, devices, and materials are described herein, but are not intended to be limiting unless so noted.

Unless otherwise indicated, the terms "a", "an", and "the" refer to "one or more" when used in the subject specification, including the claims. The term "a plurality" refers to at least two.

All numbers expressing quantities of components, conditions, and otherwise used in the specification and claims are to be understood as being modified in all instances by the term "about". Accordingly, unless indicated to the contrary, the numerical parameters set forth in the instant specification and attached claims are approximations that can vary depending upon the desired properties sought to be obtained by the presently disclosed subject matter. As used herein, the term "about", when referring to a value or to an amount of mass, weight, volume, or length can encompass variations of, in some embodiments ±20%, in some embodiments ±10%, in some embodiments ±5%, in some embodiments ±1%, in some embodiments ±0.5%, and in some embodiments to ±0.1%, from the specified amount, as such variations are appropriate in the disclosed application.

It is understood that, in light of a reading of the foregoing description, those with ordinary skill in the art will be able to make changes and modifications to the present invention without departing from the spirit or scope of the invention, as defined herein. For example, those skilled in the art may substitute materials supplied by different manufacturers than specified herein without altering the scope of the present invention.

What is claimed is:

1. An apparatus that restrains an individual from swimming beyond a predetermined range, wherein the apparatus consists essentially of:

a. a frame, comprising a face segment and a base segment;

b. a ballast unit;

c. a tether line; and, d. a means to secure the individual to the tether line, wherein the means is selected from a belt or a vest or a girdle or a combination thereof;

wherein the ballast unit is configured to function in conjunction with the frame such that the ballast unit restrains the frame from moving when the frame has been positioned on a secure surface, and wherein the tether line is secured to the frame and to the means to secure the individual to the tether line, so that the individual is restrained from swimming farther away from the frame than the maximum distance allowed by the tether line.

2. The apparatus of claim 1 wherein the ballast unit provides a counterweight of at least 24 pounds.

3. The apparatus of claim 2 wherein the ballast unit provides a counterweight of about 35 pounds.

4. The apparatus of claim 2 wherein the ballast unit is a pillow or bladder that can be reversibly filled with a liquid.

5. The apparatus of claim 4 wherein the pillow has a cylindrical tubular shape or a V-shape.

6. The apparatus of claim 1 wherein the frame base segment comprises a U-shaped segment.

7. The apparatus of claim 6 wherein the U-shaped segment has a rounded-U configuration, a three-sided-U configuration, or a four-sided-U configuration.

8. The apparatus of claim 1 wherein the frame face segment comprises a U-shaped segment that is equal in length or shorter than the base segment.

9. The apparatus of claim 1 wherein the ballast unit has a cylindrical tubular shape and the frame is configured to hold the cylindrical shaped ballast unit.

10. The apparatus of claim 9 wherein the frame comprises a base segment and the base segment is bent in a sinusoidal wave pattern with the wavelength large enough to allow the ballast unit to lay within a trough of a wave.

11. The apparatus of claim 1 wherein the tether line is made from a material that will retain tension when exposed to water, cotton cord, polypropylene cord, nylon cord, bungee cord, climbing rope, kernmantle-design rope, or combinations thereof.

12. The apparatus of claim 1 wherein the frame is configured to allow the face segment to move relative to the base segment from an orientation wherein the face segment abuts and is essentially parallel to the base segment to an orientation wherein the face segment is essentially perpendicular to the base segment.

13. The apparatus of claim 1 wherein the ballast unit comprises more than one piece or segment.

14. An apparatus that restrains an individual from swimming beyond a predetermined range, wherein the apparatus consists essentially of:

a. a frame, wherein the frame comprises a base segment, a face segment, and a first folding joint and a second folding joint, wherein the base segment defines a first end and a second end and wherein the face segment defines a first end and a second end, and wherein the base segment first end is affixed to the first folding joint and the face segment first end is affixed to the first folding joint and the base segment second end is affixed to the second folding joint and the face segment second end is affixed to the second folding joint such that the first folding joint and second folding joint work in unison to allow the face segment to move relative to the base segment from an orientation wherein the face segment abuts and is essentially parallel to the base segment to an orientation wherein the face segment is essentially perpendicular to the base segment;

b. a ballast unit capable of providing a counterweight of at least 24 pounds;

c. a tether line; and, d. a means to secure the individual to the tether line, wherein the ballast unit is configured to function in conjunction with the frame such that the ballast unit restrains the frame from moving when the frame has been positioned on a secure surface, and wherein the tether line is secured to the frame and to the means to secure the individual to the tether line, so that the individual is restrained from swimming farther away from the frame than the maximum distance allowed by the tether line.

15. The apparatus of claim 14 wherein the ballast unit is a pillow or bladder that can be reversibly filled with a liquid.

16. The apparatus of claim 14 wherein the frame base segment further comprises a bar having a first end and a second end, and wherein the bar first end is affixed to the first folding joint and wherein the bar second end is affixed to the second folding joint.

17. The apparatus of claim 14 wherein the folding joints are selected from the group consisting of brackets that allow for axles to secure the frame ends to the brackets, friction hinges, friction hinges with protective sleeves, and combinations thereof.

* * * * *